US005610479A

United States Patent [19]

Schmitt

[11] Patent Number: 5,610,479

[45] Date of Patent: Mar. 11, 1997

[54] CIRCUIT ARRANGEMENT FOR OPERATING LOW-PRESSURE DISCHARGE LAMPS

[75] Inventor: Harald Schmitt, Munich, Germany

[73] Assignee: Patent-Treuhand-Gesellschaft für elektrische Glühlampen mbH, Munich, Germany

[21] Appl. No.: 381,978

[22] PCT Filed: Nov. 11, 1993

[86] PCT No.: PCT/DE93/01079

§ 371 Date: Feb. 13, 1995

§ 102(e) Date: Feb. 13, 1995

[87] PCT Pub. No.: WO94/12007

PCT Pub. Date: May 26, 1994

[30] Foreign Application Priority Data

Nov. 13, 1992 [DE] Germany ..... 42 38 409.5

[51] Int. Cl.[6] ..... H05B 37/02

[52] U.S. Cl. ..... 315/226; 315/209 R; 315/224; 315/244; 315/DIG. 7

[58] Field of Search ..... 315/200 R, 209 R, 315/224, 226, 244, 106, DIG. 2, DIG. 5, DIG. 7

[56] References Cited

U.S. PATENT DOCUMENTS

| | | | |
|---|---|---|---|
| 4,547,706 | 10/1985 | Krummel | 315/226 |
| 4,553,070 | 11/1985 | Sairanen et al. | 315/209 R |
| 4,572,989 | 2/1986 | Zuchtriegel | 315/209 R |
| 4,782,268 | 11/1988 | Fähnrich et al. | 315/200 R |

FOREIGN PATENT DOCUMENTS

| | | |
|---|---|---|
| 0371439A3 | 6/1990 | European Pat. Off. . |
| 0395776B1 | 11/1990 | European Pat. Off. . |
| 2520575 | 7/1983 | France . |
| 2261332 | 5/1993 | United Kingdom . |

*Primary Examiner*—Robert Pascal
*Assistant Examiner*—Haissa Philogene
*Attorney, Agent, or Firm*—Frishauf, Holtz, Goodman, Langer & Chick, P.C.

[57] ABSTRACT

A circuit arrangement for high-frequency operation of a low-pressure discharge lamp (18) includes a mains rectifier (10), a radio interference suppression filter (12) connected to the mains rectifier (10), an RF inverter (14), connected to the direct current output of the mains rectifier (10) and having two alternatingly switching transistors ($T_1$, $T_2$) along with an inductance ($L_K$), a trigger circuit and a center tap (M), which is between the two transistors ($T_1$, $T_2$). A filter capacitor ($C_S$) is connected parallel to the switching paths of the two transistors ($T_1$, $T_2$) of the RF inverter (14). A series resonant circuit (16) is assigned to the low-pressure discharge lamp (18), and comprises a resonant inductance ($L_3$), a coupling capacitor ($C_3$), and a resonant capacitance parallel to the lamp. The connection lines for the low-pressure discharge lamp (18) lead on the one hand from a first electrode ($E_1$) via the resonant inductance ($L_3$) to the center tap (M) and on the other from a second electrode ($E_2$) via the center tap of a diode series circuit, connected in the direct current forward direction in series with the filter capacitor ($C_S$) and comprising a first and a second diode ($D_1$, $D_2$), to the positive and negative terminal, respectively, of the mains rectifier (10). The capacitance parallel to the lamp of the series resonant circuit (16) assigned to the low-pressure discharge lamp (18) comprises two parallel-connected capacitors ($C_{R1}$, $C_{R2}$); one ($C_{R2}$) of the capacitors ($C_{R1}$, $C_{R2}$) parallel to the lamp is connected directly to the positive or negative terminal of the filter capacitor ($C_S$).

9 Claims, 5 Drawing Sheets

CIRCUIT ARRANGEMENT FOR OPERATING LOW-PRESSURE DISCHARGE LAMPS

FIELD OF THE INVENTION

The-invention relates to a circuit arrangement for high-frequency operation of one or more parallel- or serially-connected low-pressure discharge lamps.

BACKGROUND

A circuit arrangement to operate low-pressure discharge lamps is described in European Patent Application 0 395 776, Krummel. However, it has the disadvantage, first, that higher costs and a greater space requirement are created as a result of additional limiter diodes at the lamp base point, along with a necessarily fast bridge rectifier and an expensive radio interference suppressor filter on the alternating voltage side. Secondly, the circuit is also less suitable for relatively low mains voltages combined with high lamp burning and igniting voltages, since the full resonant capacitance is parallel to the lamp and consequently the converted idle output—which is necessary to generate the high burning and igniting voltages—undergoes a very major modulation as a function of the instantaneous value of the rectified mains voltage.

THE INVENTION

It is an object of the present invention to provide a circuit arrangement of the type described at the outset, which, with technically simple means, without increased interfering radiation and at low additional power losses, assures both an increase in the power factor of the circuit arrangement and reliable operation without a protective circuit.

The circuit according to the invention includes a pump circuit, in which the positive terminal of the rectified alternating mains voltage, on the output side of a radio interference suppression filter, is connected to the base point of the lamp via a first fast diode polarized in the forward direction. This point is connected to the positive terminal of the filter capacitor via a second diode also polarized in the forward direction.

The modulation of the lamp current and the generation of the harmonics is reduced by the capacitor being located parallel to the second diode of the diode series circuit.

Further radio interference suppression is achieved by means of a further capacitor, which is connected parallel to the first diode.

Preferably, the capacitance of the series resonant circuit assigned to each low-pressure discharge lamp is formed by two parallel-connected capacitors; the following inequality is desirable for the ratio between the capacitances of the two capacitors $C_{R1}$ and $C_{R2}$ (connected to the filter capacitor):

$$0.5<C_{R1}/C_{R2}<2$$

In a further embodiment, the other of the two capacitors, given suitable filaments, can be replaced by suitably modified preheating capacitors.

According to the invention, a current takeup from the mains during one-half of a period of the RF inverter results, and then charging (pumping) of the filter capacitor during the other half period. By placing a choke before the first diode and connecting a capacitor parallel to the second diode, it is assured that the charging process will not be interrupted at the time periods when the mains voltage drops below half the filter capacitor voltage. Overpumping or a voltage overload especially during ignition is prevented in this circuit arrangement due to attenuation of the pump process, by providing that the resonant capacitance parallel to the lamp is split into at least two capacitors, and one of the at least two capacitors is connected directly to the positive or negative terminal, respectively, of the filter capacitor. This not only prevents an overvoltage at this capacitor but also reduces the modulation of the lamp current, without also markedly worsening the ignitability of the circuit.

A further improvement is obtained by connecting a capacitor parallel to the first diode. The current across this first diode is very rich in harmonics and causes major radio interference, especially in the range above 1 MHz. The capacitor having a capacitance of approximately 1 to 5 nF brings about a pronounced reduction in harmonics of the operating frequency (50 kHz) and thus a drastic reduction in radio interference.

DRAWINGS

Further advantages and characteristics of the invention will become apparent from the ensuing description of various embodiments and from the drawings, to which reference is made. Shown are:

FIG. 1, a block circuit diagram of the circuit arrangement in a first embodiment;

FIG. 2, a circuit diagram of the circuit arrangement of FIG. 1;

FIG. 3, a block circuit diagram of a further embodiment of the circuit arrangement for operating a plurality of parallel-connected low-pressure discharge lamps with a common pump branch;

FIG. 4, a block circuit diagram of a further embodiment of the circuit arrangement for operating a plurality of parallel-connected low-pressure discharge lamps with separate pump branches;

FIG. 5, a block circuit diagram of a further embodiment of the circuit arrangement for operating a plurality of serially-connected low-pressure discharge lamps with a common pump branch.

DETAILED DESCRIPTION

Figure 1:
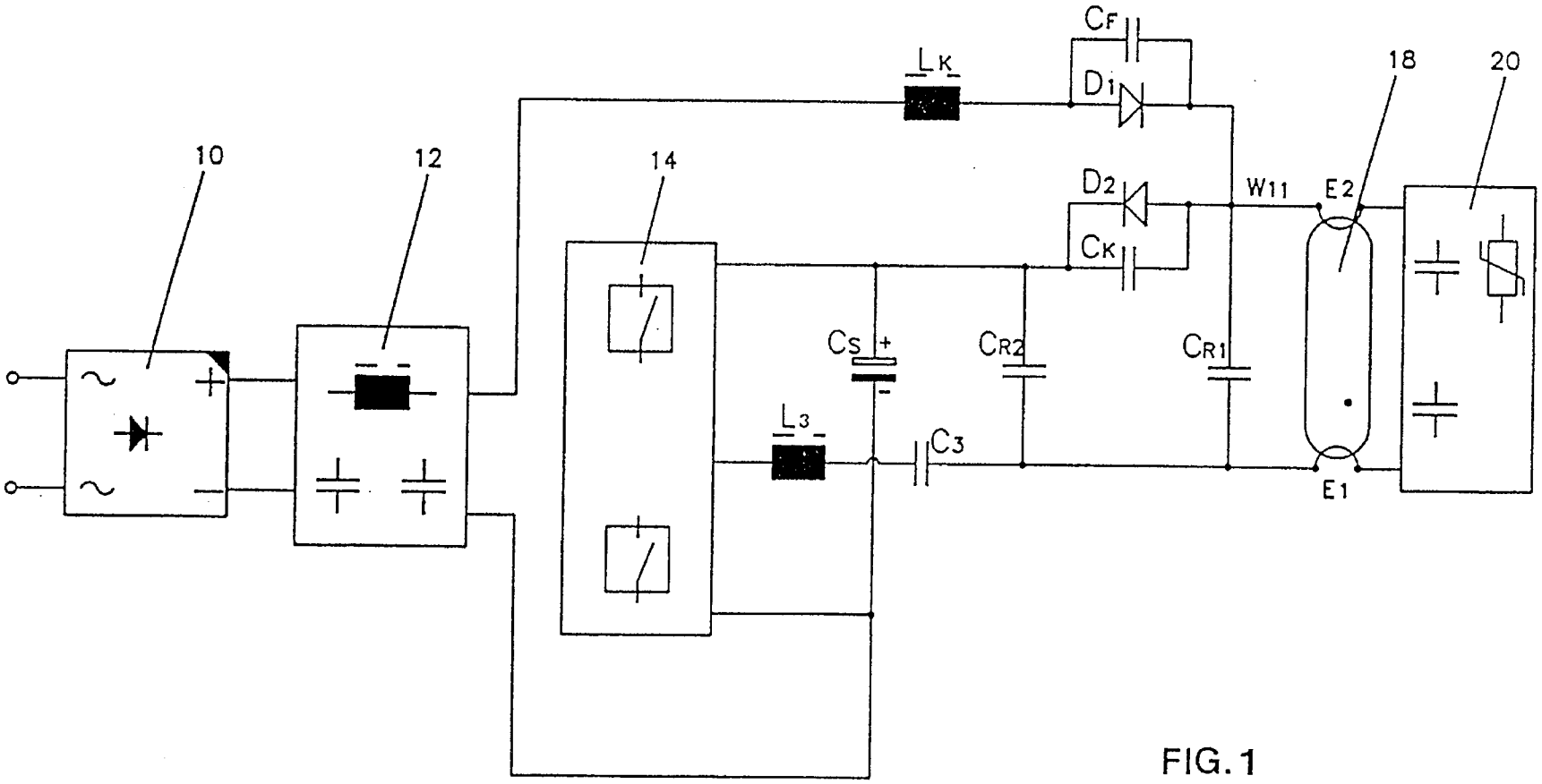

In the block circuit diagram shown in FIG. 1, a high-frequency filter or radio interference suppression filter 12 is connected to the outputs of a mains rectifier 10, or vice versa, and that filter 12 is followed by an RF inverter 14 with two alternatingly switching transistors $T_1$ and $T_2$ and a trigger circuit with a center tap M (FIG. 2) between the two transistors $T_1$ and $T_2$. A low-pressure discharge lamp 18 is connected via a series resonant circuit, marked 16 in FIG. 2, between the center tap M of the two transistors $T_1$ and $T_2$ and the positive terminal of the radio interference suppression filter 12. A filter capacitor $C_S$ connected between the two inputs of the RF inverter 14 is connected by its negative terminal to the negative terminal of the interference filter 12.

The positive terminal of capacitor $C_S$ is connected to the positive terminal of the interference filter 12, via a series diode circuit comprising diodes $D_1$ and $D_2$ connected in series and in the direct current forward direction. An inductance $L_K$ is located between the first diode $D_1$ of the diode series circuit and the positive terminal of the interference filter 12. It serves to charge the filter capacitor $C_S$, when the mains voltage drops below half the $C_S$ voltage. The first diode $D_1$ and the second diode $D_2$ provide that in one half-period of the RF inverter 14 the filter capacitor $C_S$ is charged, and in the other half period current is taken from the mains. A capacitor $C_K$ connected parallel to the diode $D_2$ assist in oscillation of the RF inverter 14 and improves the ignitability of the circuit. An additional capacitor $C_F$, connected parallel to the first diode $D_1$, provides radio interference suppression. A first electrode $E_1$ of the low-pressure discharge lamp 18 is connected to the center tap M of the RF inverter via the inductance $L_3$ and a capacitor $C_3$; the second electrode $E_2$ of the low-pressure discharge lamp 18 is connected to a tap or base point $W_{11}$, which is located between the first diode $D_1$ and the second diode $D_2$. An ignition circuit 20 is connected to the respective other outputs of the electrodes $E_1$ and $E_2$.

In accordance with a feature of the invention, the resonance capacitance parallel to the lamp comprises two capacitors $C_{R1}$ and $C_{R2}$. The first capacitor $C_{R1}$, via the base point $W_{11}$, connects together the two electrodes $E_1$ and $E_2$ of the low-pressure charge lamp 18 and is thus connected between diodes $D_1$ and $D_2$ of the series diode circuit.

Figure 2:
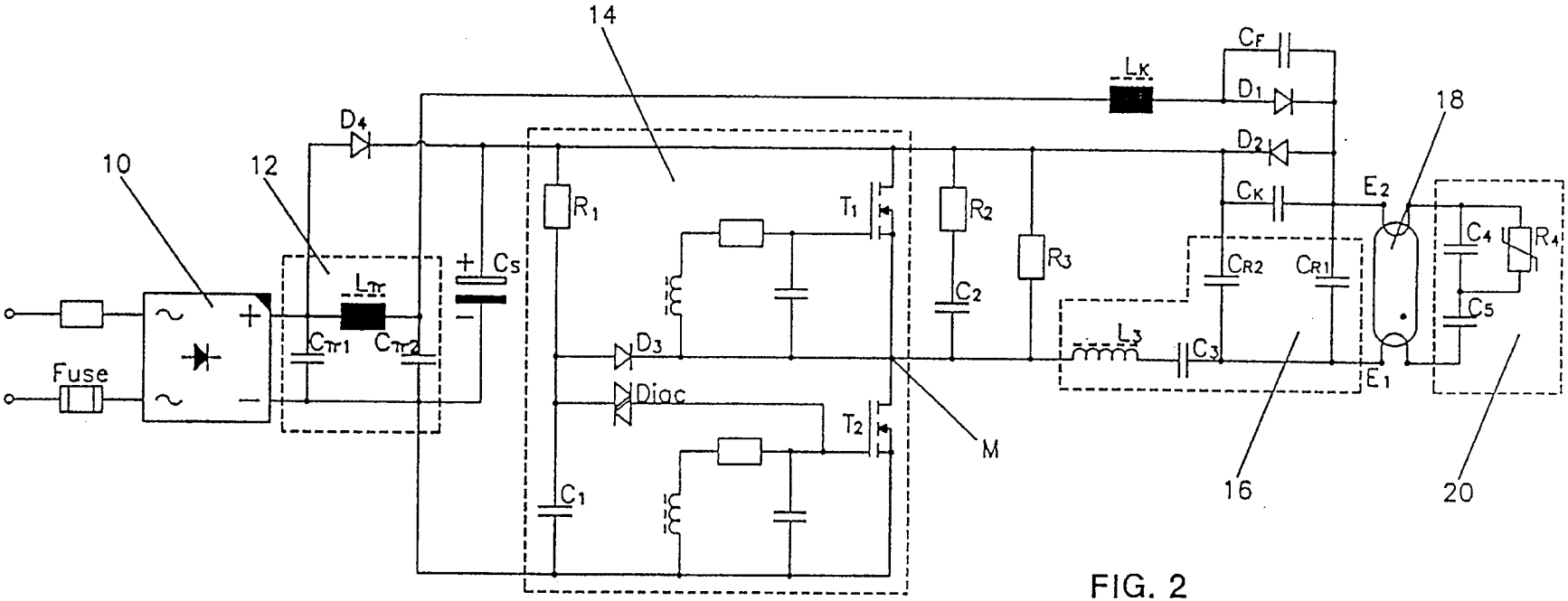

The second capacitor $C_{R2}$ is located parallel to the first capacitor $C_{R1}$, but on the output side of the second diode $D_2$, and connected to one of the terminals, in FIGS. 1 and 2 to the positive terminal of filter capacitor $C_S$.

In FIG. 2, a physical embodiment of the version of FIG. 1 is shown. In this circuit diagram of the circuit arrangement, the interference filter 12 is connected to the positive and negative terminal, respectively, of the mains rectifier 10; this filter comprises two capacitors $C\pi_1$ and $C\pi_2$, each with a capacitance of 150 nF, and an inductance $L\pi$ of 680 μH, which connects the two capacitors $C\pi_1$ and $C\pi_2$.

The negative terminal of the filter capacitor $C_S$ is connected via the interference filter 12 to the negative terminal of the mains rectifier 10, while the positive terminal of the filter capacitor $C_S$ is connected, via the second diode $D_2$ and the capacitor $C_K$ connected parallel to it, to the second electrode $E_2$ of the low-pressure discharge lamp 18, and via a fourth diode D4 to the interference filter 12. The second diode $D_2$ connects the filter capacitor $C_S$ to the positive terminal of the mains rectifier 10, via the first diode $D_1$ and the choke $L_K$ having an inductance of 470 μH, via the interference filter 12. The capacitor $C_F$ connected parallel to the first diode $D_1$ has a capacitance of approximately 1 to 5 nF. The RF inverter 14 is on the one hand connected between the second diode $D_2$ and the positive terminal of the filter capacitor $C_S$ and on the other is connected to the negative terminal of the mains rectifier 10 via the interference filter 12. The center tap M of the push-pull frequency generator 14 is connected to the first electrode $E_1$ of the low-pressure discharge lamp 18, via an inductance $L_3$ and a capacitor $C_3$. Together with the capacitors $C_1$ and $C_2$ parallel to the lamp, the inductance $L_3$ and the capacitor $C_3$ form the series resonant circuit 16 associated with the low-pressure discharge lamp 18.

The ignition circuit 20 connected to the other two terminals of the electrodes $E_1$ and $E_2$ has, parallel to the electrodes $E_1$ and $E_2$, two series-connected capacitors $C_4$ and $C_5$; a temperature-dependent resistor $R_4$ is provided parallel to the one capacitor $C_4$. The series circuit comprising the capacitors $C_4$ and $C_5$ contributes to the total resonant capacitance comprising $C_{R1}$ and $C_{R2}$.

Figure 3:
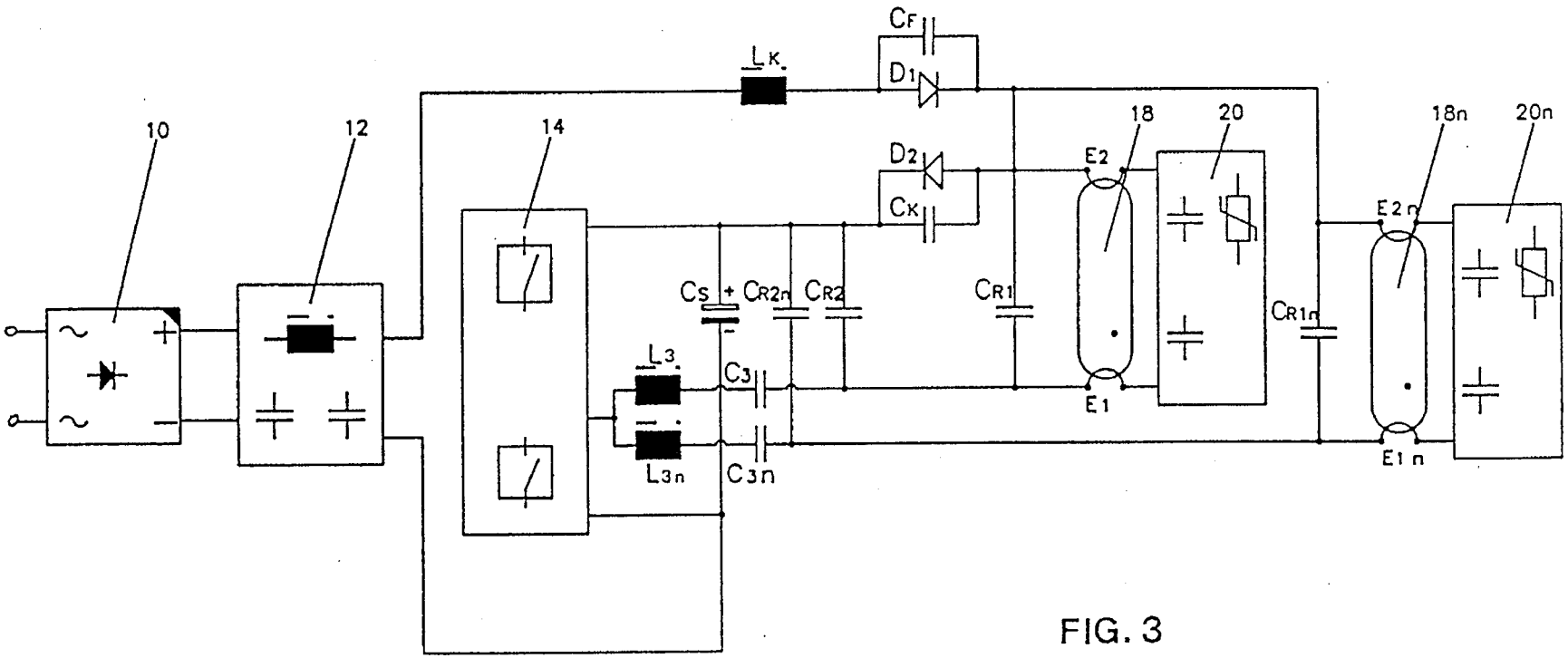
Figure 4:
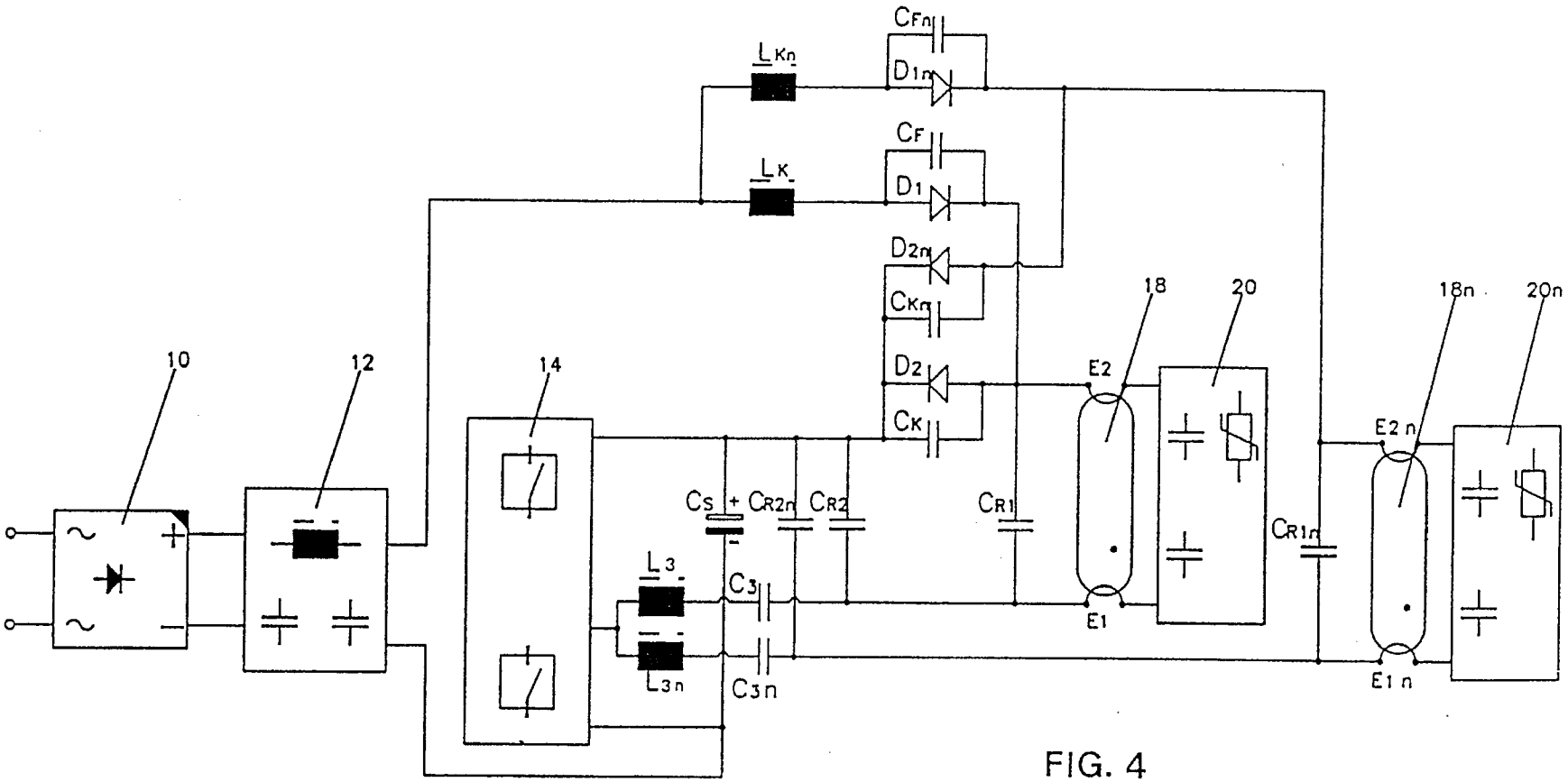
Figure 5:
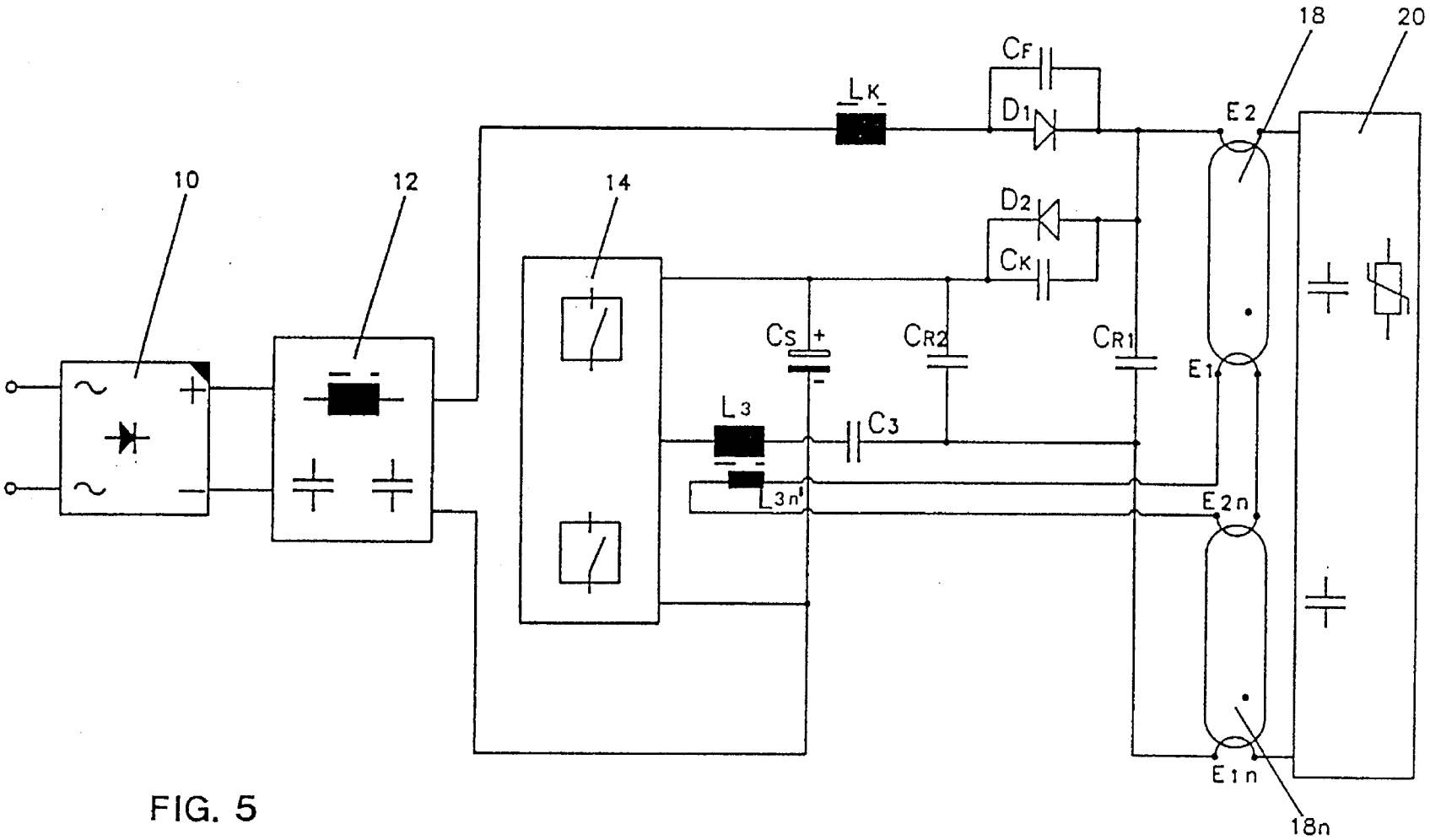

FIGS. 3–5 show circuit arrangements with which two and more low-pressure discharge lamps 18, 18*n* can be operated.

In FIG. 3, a circuit arrangement is shown for operating two and more parallel-connected low-pressure discharge lamps 18 and 18*n*, all of which are operated with a common pump branch. One ignition circuit 20*n* each, one additional capacitor $C_{R1n}$ and $C_{R2n}$, which is connected parallel to the first capacitor $C_{R1}$ and $C_{R2}$, respectively, and one lamp choke $L_{3n}$ each and one coupling capacitor $C_{3n}$ each are provided for each further low- pressure discharge lamp 18*n*.

FIG. 4 shows a circuit arrangement for two and more parallel-connected low-pressure discharge lamps 18*n* with separate pump branches. The difference from the embodiment of FIG. 3 is that the further capacitor $C_{R1n}$ is connected to a further pump branch. The further pump branch is connected parallel to the first pump branch and comprises the further inductance $L_{Kn}$, a further diode series circuit $D_{1n}$ and $D_{2n}$, and the respective parallel-connected further capacitors $C_{Kn}$ and $C_{Fn}$.

One example of two and more low-pressure discharge lamps 18, 18*n* connected in series is shown in FIG. 5. All the series-connected low-pressure discharge lamps 18 and 18*n* have a single shared ignition circuit 20. The difference from the embodiment of FIG. 1 is that the first electrode E1 of the first low-pressure discharge lamp 18 is connected in series with the second electrode $E_{2n}$ of the further low-pressure discharge lamp 18*n* and is connected to a galvanically separate preheater, which comprises an additional coil $L_{3n}$, on the lamp choke $L_3$.

The following component list shows the circuit elements used for a circuit arrangement for operating a 20 W compact fluorescent lamp connected to 120 V alternating voltage:

| | |
|---|---|
| $C_1$ = 100 nF | $R_1$ = 330 kΩ |
| $C_2$ = 2.2 nF | $R_2$ = 10 Ω |
| $C_3$ = 150 nF | $R_3$ = 470 kΩ |
| $C_4$ = 2.2 nF | |
| $C_5$ = 6.8 nF | |
| $C\pi_1$ = $C\pi_2$ = 150 nF | |
| $CR_1$ = 4.7 nF | |
| $CR_2$ = 3.3 nF | $L\pi$ = 680 μH |
| $C_S$ = 47 μF/33μF | $L_K$ = 330 μH |
| $C_F$ = 3.3 nF | $L_3$ = 1.4 mH |
| $C_K$ = 15 nF | |
| $D_1$ = BA 157 | $T_1$ = $T_2$ = IRF 224 |
| $D_2$ = BA 157 | |
| $D_3$ = 1N4004 | |
| $D_4$ = 1N4004 | |

I claim:

1. A circuit arrangement for high-frequency operation of one or more low-pressure discharge lamps (18) connected to one another in parallel or in series, having a mains rectifier (10);

a radio interference suppression filter (12) connected to the mains rectifier (10);

an RF inverter (14), connected to the direct current output of the mains rectifier (10) and having two alternatingly switching transistors ($T_1$ and $T_2$) , an inductance ($L_K$), a trigger circuit, and a center tap (M) between the two transistors ($T_l$, $T_2$);

a filter capacitor ($C_S$) parallel to the switching paths of the two transistors ($T_1$, $T_2$) of the RF inverter (14);

one or more series resonant circuits (16), each assigned to one low-pressure discharge lamp (18), comprising a coupling capacitor ($C_3$), a resonant inductance ($L_3$), and a resonant capacitance parallel to the lamp;

a series diode circuit comprising first and second diodes ($D_1$, $D_2$) connected in direct current forward direction, and defining a center point ($W_{11}$) therebetween, and having one input connected to said filter capacitor ($C_S$);

connecting lines for the low-pressure discharge lamp or lamps (18), in which a first line of the first electrodes ($E_1$) of the low-pressure discharge lamp or lamps (18) is connected to the center tap (M) via the resonant inductance ($L_3$), and one further line, connected to each of the second electrode or electrodes ($E_2$) of the low-pressure discharge lamp or lamps (18) is further connected to the positive or negative terminal of the mains rectifier (10), via the center point ($W_{11}$) of the diode series circuit;

characterized in that the resonant capacitance of the series resonant circuit (16) assigned to each low-pressure discharge lamp (18) is divided into a plurality of resonance capacitors ($C_{R1}$, $C_{R2}$), each having one terminal connected together, one ($CR_1$) of the resonance capacitors ($C_{R1}$, $C_{R2}$) is effectively connected across the electrodes of the lamp or lamps, and the other ($C_{R2}$) Of the capacitors ($C_{R1}$, $C_{R2}$) has its other terminal connected directly to the positive or negative terminal of the filter capacitor ($C_S$).

2. The circuit arrangement of claim 1 characterized in that one capacitor ($C_S$) is connected parallel to the second diode ($D_2$) of the diode series circuit.

3. The circuit arrangement of claim 1, characterized in that one capacitor ($C_F$) is connected parallel to the first diode ($D_1$) of the diode series circuit.

4. The circuit arrangement of claims 1, characterized in that the capacitance parallel to the lamp of the series resonant circuit (16) assigned to each low-pressure discharge lamp (18) comprises two parallel-connected capacitors ($C_{R1}$ and $CR_{R2}$).

5. The circuit arrangement of claim 4, characterized in that the following inequality applies to the ratio of the capacitances of the one and another capacitors $C_{R1}$ and $C_{R2}$ parallel to the lamp:

$$0.5<C_{R1}/C_{R2}<2$$

6. The circuit arrangement of claim 5, characterized in that the interference filter (12) is located following the mains rectifier (10);

the inductance ($L_K$), the first diode ($D_1$) and the second diode ($D_2$) as well as the filter capacitor ($C_S$) are connected in series between the outputs of the interference filter (12);

the RF inverter (14) is located between the terminal point between the second diode ($D_2$) and the filter capacitor ($C_S$) and one output of the interference filter (12);

a resistor ($R_1$) and a capacitor ($C_1$) are located in series between the terminal point between the second diode ($D_2$) and the filter capacitor ($C_S$) and one output of the interference filter (12);

a bidirectional thyristor diode (DIAC) is connected in series between a terminal point, present between the resistor ($R_1$) and the capacitor ($C_1$), and the gate of the second transistor ($T_2$);

the one capacitor ($C_{R1}$) of the series resonant circuit (16) is connected in parallel to the lamp between the center tap (M) and between the center point (W11) between the first diode ($D_1$) and the second diode ($D_2$), and the other capacitor ($C_{R2}$) is connected to a point located between the second diode ($D_2$) and the filter capacitor ($C_S$);

a capacitor ($C_K$) is connected parallel to the second diode ($D_2$);

the low-pressure discharge lamp or lamps (18) are connected parallel to the first capacitor ($C_{R1}$);

a further resistor ($R_3$) is connected between the second diode ($D_2$) and the filter capacitor ($C_S$) and the center tap (M);

a resistor ($R_2$) and a further capacitor ($C_2$) are connected in series and parallel with the further resistor ($R_3$);

a preheating circuit including two preheating capacitors ($C_4$, $C_5$), connected in series, is connected in parallel to the low-pressure discharge lamp (18), and a continuously self-adjusting ohmic resistor ($R_4$) whose resistance change is dependent on its temperature is connected to the first capacitor ($C_4$);

a third diode ($D_3$) is connected in series between the first resistor ($R_1$) and the first capacitor ($C_1$) and the center tap (M) ; and that the positive terminal of the filter capacitor ($C_S$) is connected to the interference filter (12) via a fourth diode ($D_4$).

7. The circuit arrangement of claim 6, characterized in that the following components have the listed values or dimensions:

| | |
|---|---|
| First capacitor | $C_1$ = 100 nF |
| | $C_2$ = 2.2 nF |
| Coupling capacitor | $C_3$ = 150 nF |
| Preheater circuit | $C_4$ = 2.2 nF |
| capacitors | $C_5$ = 6.8 nF |
| | $C\pi_1$ and $C\pi_2$ = 150 nF |
| Resonance capacitor | $CR_1$ = 4.7 nF |
| Resonance capacitor | $CR_2$ = 3.3 nF |
| Filter capacitor | $C_5$ = 47 μF |
| | $C_F$ = 3.3 nF |
| Capacitor | $C_K$ = 15 nF |
| First diode | $D_1$ = BA 157 |
| Second diode | $D_2$ = BA 157 |
| Third diode | $D_3$ = 1N4004 |
| Fourth diode | $D_4$ = 1N4004 |
| | DIAC = N413 |
| First Resistor | $R_1$ = 330 kΩ |
| Resistor | $R_2$ = 10 Ω |
| Further resitor | $R_3$ = 470 kΩ |
| | $L\pi$ = 680 μH |
| Inductance | $L_K$ = 330 μH |
| Resonant inductance | $L_3$ = 1.4 mH |
| Switching transistors $T_1$ and $T_2$, Type IRF 224 | |

8. The circuit arrangement of claim 6, characterized in that the capacitance of said one capacitor ($C_{R1}$) of the two capacitors ($C_{R1}$, $C_{R2}$) and connected effectively parallel to the electrodes ($E_1$, $E_2$) is formed by said preheating capacitors ($C_4$, $C_5$).

9. The circuit arrangement of claim 1 characterized in that the coupling capacitor ($C_3$) is connected according to one of;

between the resonant inductance and the junction points of the other capacitor ($C_{R2}$) parallel to the lamp and the resonant inductance ($L_3$), or between the junction point of the resonant inductance ($L_3$) with the other capacitor ($C_{R2}$) parallel to the lamp and the junction point of the first capacitor ($C_{R1}$) parallel to the lamp and the first electrode ($E_1$), or between the junction point of the first and second diode ($D_1$, $D_2$) and the one capacitor ($C_{R1}$) parallel to the lamp and the second electrode ($E_2$), or between the resonant inductance ($L_3$) and the junction point of the center tap (M) and the further resistor ($R_3$).

* * * * *